US009009896B2

(12) United States Patent
Suh

(10) Patent No.: US 9,009,896 B2
(45) Date of Patent: Apr. 21, 2015

(54) ADJUSTABLE FOLDABLE BED FRAME

(75) Inventor: Bernard J. Suh, Ambler, PA (US)

(73) Assignee: Pragma Corporation, Colmar, PA (US)

( * ) Notice: Subject to any disclaimer, the term of this patent is extended or adjusted under 35 U.S.C. 154(b) by 273 days.

(21) Appl. No.: 13/478,649

(22) Filed: May 23, 2012

(65) Prior Publication Data

US 2013/0312185 A1 Nov. 28, 2013

(51) Int. Cl.

| | |
|---|---|
| ***A61G 7/015*** | (2006.01) |
| ***A47C 19/12*** | (2006.01) |
| ***A47C 20/04*** | (2006.01) |

(52) U.S. Cl.

CPC ..... *A47C 20/043* (2013.01); *A47C 19/122* (2013.01)

(58) Field of Classification Search

USPC ..... 5/613, 617, 618, 620, 86.1, 627, 16, 5/174, 202

See application file for complete search history.

(56) References Cited

U.S. PATENT DOCUMENTS

| | | | | | |
|---|---|---|---|---|---|
| 1,518,210 | A | * | 12/1924 | MacDonald | 5/618 |
| 3,051,965 | A | * | 9/1962 | Szemplak et al. | 5/616 |
| 3,510,886 | A | * | 5/1970 | Benoit et al. | 5/611 |
| 4,011,609 | A | * | 3/1977 | Bethlen | 5/600 |
| 4,592,104 | A | * | 6/1986 | Foster et al. | 5/616 |
| 4,670,922 | A | | 6/1987 | Mis | |
| 4,856,497 | A | * | 8/1989 | Westphal | 606/242 |
| 4,970,737 | A | | 11/1990 | Sagel | |
| 5,216,769 | A | | 6/1993 | Eakin | |
| 5,245,718 | A | | 9/1993 | Krauska | |
| 5,438,723 | A | | 8/1995 | Carroll | |
| 5,568,661 | A | * | 10/1996 | Bathrick et al. | 5/618 |
| 5,579,550 | A | * | 12/1996 | Bathrick et al. | 5/620 |
| 6,009,575 | A | | 1/2000 | Hsieh | |
| 6,035,467 | A | | 3/2000 | Lee | |
| 6,076,210 | A | * | 6/2000 | Wu | 5/618 |
| 6,151,730 | A | | 11/2000 | Weston | |
| 6,209,157 | B1 | | 4/2001 | Hensley | |
| 6,253,396 | B1 | * | 7/2001 | Weston | 5/110 |
| 6,735,797 | B1 | | 5/2004 | Long et al. | |

(Continued)

FOREIGN PATENT DOCUMENTS

JP 2000152852 A 6/2000

OTHER PUBLICATIONS

PCT International Searching Authority/KR, International Search Report mailed Jan. 21, 2013, International Application No. PCT/US2012/054012.

*Primary Examiner* — Nicholas Polito
(74) *Attorney, Agent, or Firm* — John H. Choi

(57) ABSTRACT

An adjustable foldable bed frame comprises an outer assembly having a body section and a leg section. Each section has a substantially rectangular periphery with an opening and is pivotally coupled together by a pair of first coupling members for movement between an open configuration whereby the sections are co-planar, and a closed configuration whereby the sections are parallel with each other. An inner assembly having a body component and a leg component are positioned within the opening of the body section and the leg section, respectively. The body component comprises a torso portion which is independently adjustable from a flat configuration to a plurality of reclined configurations. The leg component comprises a calf portion which is independently adjustable from a flat configuration to a plurality of elevated configurations. A connecting bracket assembly fixedly couples adjacent adjustable foldable bed frames such that adjacent torso and calf portions are adjustable together.

10 Claims, 6 Drawing Sheets

(56) References Cited

U.S. PATENT DOCUMENTS

| | | | | |
|---|---|---|---|---|
| 6,826,793 | B2 | 12/2004 | Tekulve | |
| 6,907,631 | B2 | 6/2005 | Heaton | |
| 6,990,698 | B2 * | 1/2006 | Wall, Sr. | 5/618 |
| 7,093,312 | B2 | 8/2006 | Mossbeck | |
| 7,493,667 | B2 | 2/2009 | Ferko, III | |
| 7,861,338 | B2 | 1/2011 | Lee | |
| 7,900,302 | B2 | 3/2011 | Long | |
| 8,056,159 | B2 | 11/2011 | Lee et al. | |
| 2002/0144350 | A1 | 10/2002 | Shih | |
| 2007/0277317 | A1 | 12/2007 | Ferko | |
| 2008/0276373 | A1 | 11/2008 | Clenet | |
| 2011/0099712 | A1 | 5/2011 | Jin | |

* cited by examiner

ADJUSTABLE FOLDABLE BED FRAME

BACKGROUND OF THE INVENTION

1. Field of the Invention

This invention relates to an improved foldable bed frame, and more particularly, to a portable foldable bed frame that is adjustable to multiple reclined and elevated configurations to provide a customized and comfortable mattress support.

2. Discussion of Related Art

Reclining beds have been in production and use for many years. Reclining beds are most commonly used by the elderly and the sick who often times need assistance to get to a sitting position to get out of bed or to perform other activities in a sitting or reclined position while in bed, such as reading, watching television or engaging in simple exercises. Reclining beds have also become popular with the general public because of the convenience of being able to recline or incline the bed to comfortably engage in those activities.

Conventional reclining beds are typically electrically operated and include many parts including a motor for adjusting the configuration of the bed. Those parts are susceptible to malfunction and failure and, thus, constant repair and maintenance are required. Furthermore, due to the many parts of the bed, conventional reclining beds are massive assemblies that often weigh hundreds of pounds, thus making it difficult for storage and transport. Conventional reclining beds are also quite expensive.

As illustrated by the prior art, efforts have been made in an attempt to provide a manual, motor-free reclining bed with similar attributes as conventional reclining beds while being affordable and portable. Even though the portable manual reclining beds in the prior art are foldable, there are several problems with those structures. Most of the manually adjustable foldable beds in the prior art can be adjusted to only a few different levels. Thus, often times the user is not able to adjust the bed to an exact desired configuration. For the few manually adjustable foldable beds in the prior art that provide more than a few levels of adjustment, it is very difficult to adjust the bed from one level to another either because of the complexity of the adjustment mechanism or because the reclining portion of the bed is too heavy. Also, the base of the manually adjustable foldable beds in the prior art is often either a solid or bulky structure and is quite heavy, making transport difficult. Moreover, very few manually adjustable beds in the prior art are capable of independently adjusting a body portion and a leg portion separately. Furthermore, there has not been a solution to providing a larger manually adjustable foldable bed that could be easily stored and transported.

Therefore, there is a need for a light-weight, portable, manually adjustable reclining bed frame that is able to form a flat horizontal surface, as well as, being able to provide multiple adjustable positions for independently inclining the torso of a person and independently raising the elevation of a person's legs. It is also desirable to have a portable adjustable reclining bed frame capable of attaching to another portable adjustable reclining bed frame to form a larger continuous mattress support surface while having the capability to synchronize adjustment of the adjacent bed frames.

BRIEF SUMMARY OF THE INVENTION

The present invention is intended to overcome at least the above-described disadvantages and to provide further improvements to adjustable foldable bed frames in the prior art. The objects and advantages of the present invention, more specifically, are to provide a light-weight, portable, manually adjustable reclining bed frame that is able to form a flat horizontal surface, as well as being able to provide separate adjustable portions for independently inclining the torso of a user and independently raising the elevation of the user's legs. It is also an object to have a portable adjustable reclining bed frame capable of attaching to another portable adjustable reclining bed frame to form a larger continuous mattress support surface while having the ability to synchronize adjustment of the adjacent bed frames.

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

For achieving the above-mentioned objects, the present invention provides an adjustable foldable bed frame comprising an outer assembly having a body section and a leg section. Each section includes a pair of opposing longitudinal beams fixedly coupled to a pair of opposing lateral beams to form a substantially rectangular periphery with an opening. Proximal ends of each section are pivotally coupled together by a pair of first coupling members for movement between an open configuration whereby the sections are co-planar, and a closed configuration whereby the sections are parallel with each other. A central leg assembly, which comprises a top surface, is fixedly coupled to the pair of first coupling members. A pair of outer leg assemblies is provided and each outer leg assembly is pivotally coupled to distal ends of each section such that each leg assembly is movable between the open configuration whereby each outer leg assembly extends downwardly from each corresponding section, and the closed configuration whereby each leg assembly lies parallel with each corresponding section. The foldable bed frame further comprises an inner assembly comprising a body component and a leg component positioned within the opening of the body section and the leg section, respectively. The body component comprises a central portion fixedly coupled to the body section proximal end and a torso portion pivotally coupled to the body section and positioned between the central portion and the body section distal end. The leg component comprises a thigh portion pivotally coupled to the leg section proximal end and a calf portion pivotally coupled to the thigh portion and positioned between the thigh portion and the leg section distal end. The foldable bed frame further comprises at least one first adjustable support member pivotally coupling the torso portion to the body section and at least one second adjustable support member pivotally coupling the calf portion to the leg section. The torso portion is adjustable from a first flat configuration whereby the torso portion is substantially co-planar with the body section, to a plurality of predetermined reclined configurations whereby the torso portion is positioned at an angle with respect to the body section. The calf portion is adjustable from a second flat configuration whereby the calf portion is substantially co-planar with the leg section, to a plurality of predetermined elevated configurations whereby the calf portion is positioned above the leg section.

In another aspect of the present invention, the adjustable foldable bed frame is provided with at least one connecting bracket assembly for fixedly coupling inner assemblies of adjacent adjustable foldable bed frames such that adjacent torso portions are collectively adjustable from the first flat configuration to the plurality of predetermined reclined configurations, and adjacent leg portions are collectively adjustable from the second flat configuration to the plurality of predetermined elevated configurations.

The foregoing has outlined rather broadly the more pertinent and important features of the present invention so that the detailed description of the invention that follows may be better understood and so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent structures do not depart from the spirit and scope of the invention as set forth in the appended claims.

BRIEF DESCRIPTION OF THE DRAWINGS

The above and other objects, features and advantages of the present invention will be more apparent from the following detailed description taken in conjunction with the accompanying drawings, in which.

Figure 1:
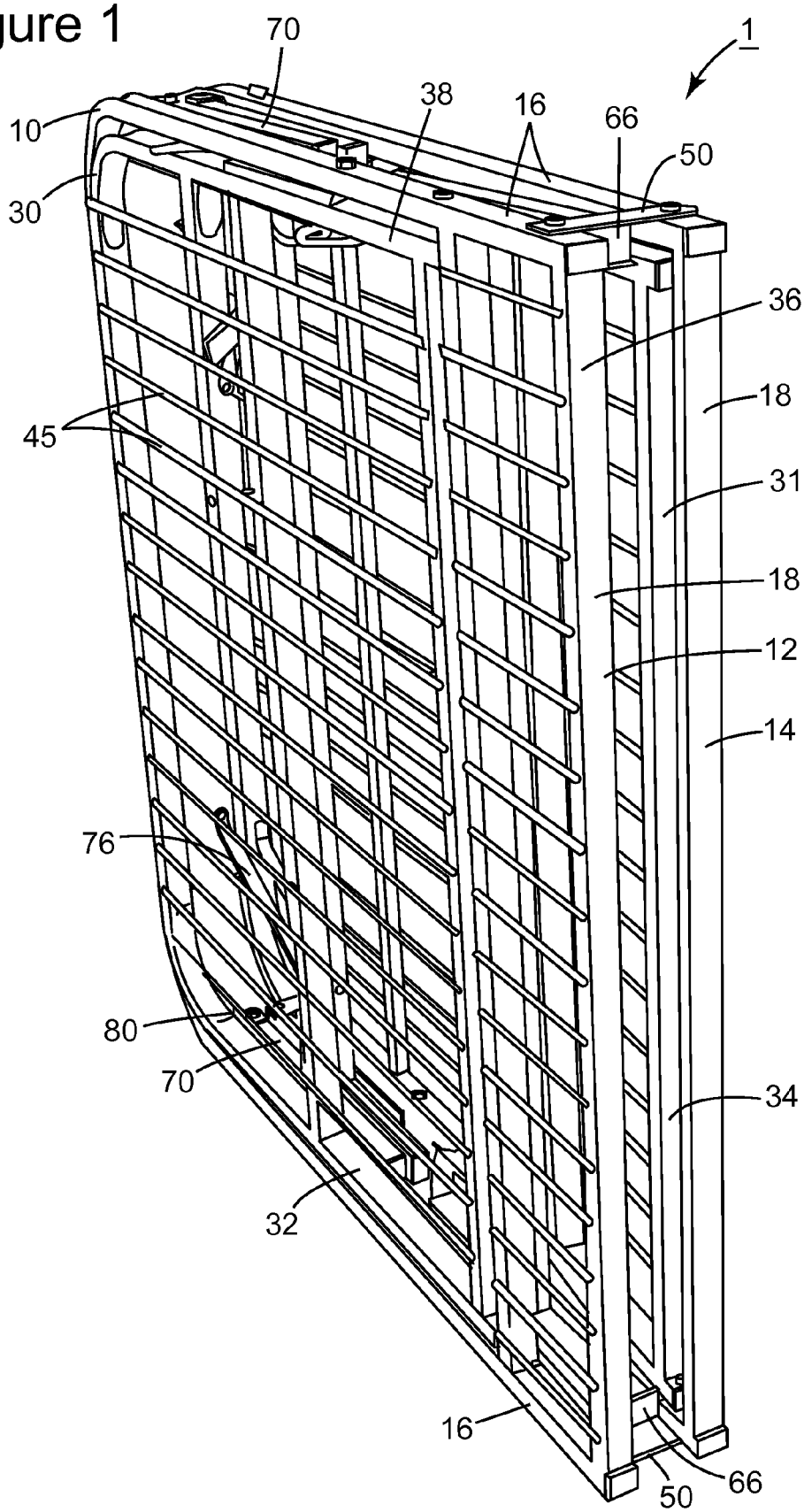
FIG. 1 is a perspective view of an embodiment of an adjustable foldable bed frame of the present invention in a closed configuration.

To facilitate an understanding of the invention, identical reference numerals have been used, when appropriate, to designate the same or similar elements that are common to the figures. Further, unless stated otherwise, the features shown in the figures are not drawn to scale, but are shown for illustrative purposes only.

DETAILED DESCRIPTION OF THE INVENTION

Exemplary embodiments are described herein to provide a detailed description of the invention. Variations of these embodiments will be apparent to those of skill in the art.

Moreover, certain terminology is used in the following description for convenience only and is not limiting. For example, the words "right," "left," "top," "bottom," "upper," "lower," "inner" and "outer" designate directions in the drawings to which reference is made. The word "a" is defined to mean "at least one." The terminology includes the words above specifically mentioned, derivatives thereof, and words of similar import.

Figure 2:
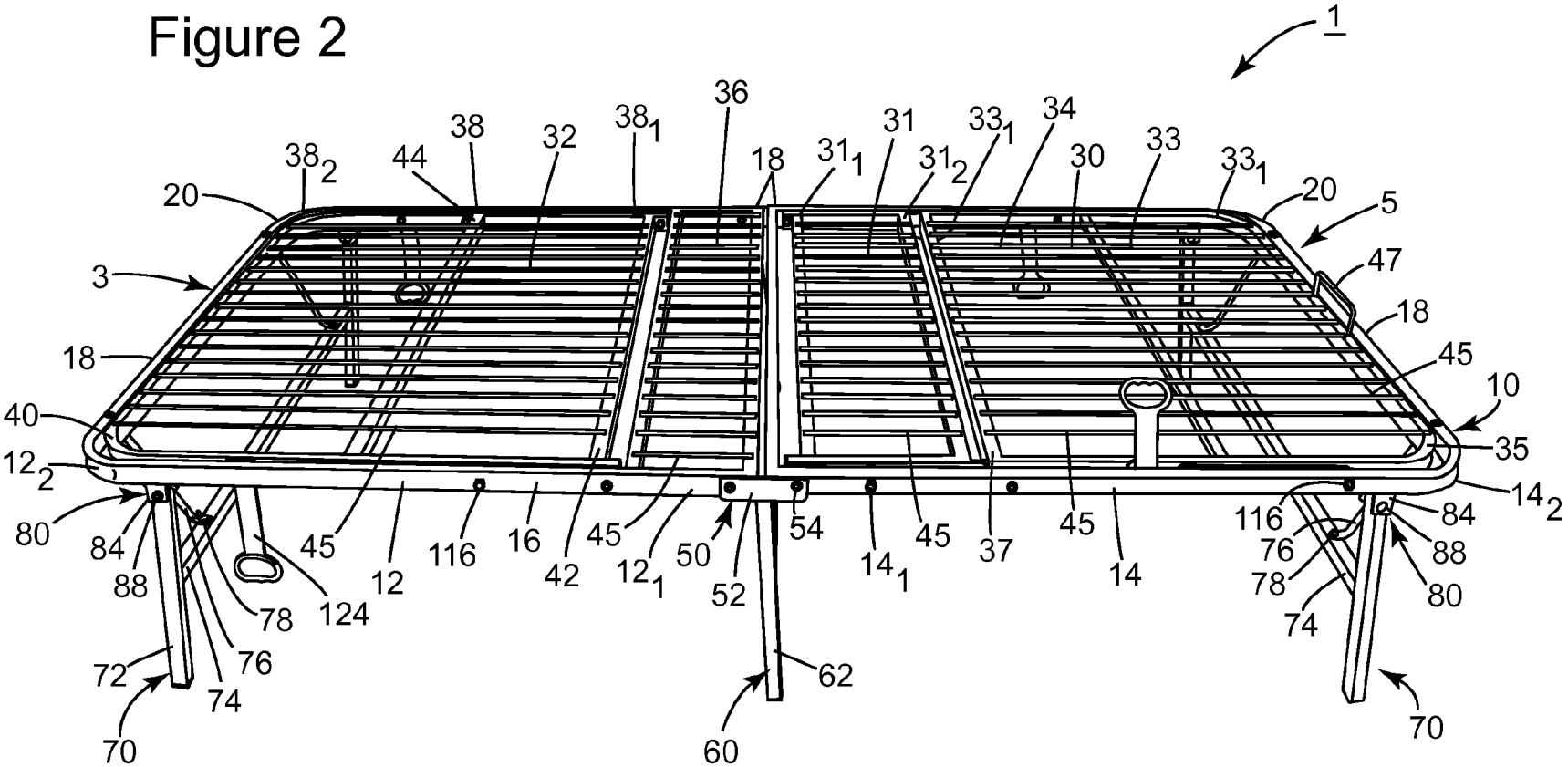
FIG. 2 is a perspective view of the adjustable foldable bed frame of FIG. 1 in open and flat configurations.
Figure 3:
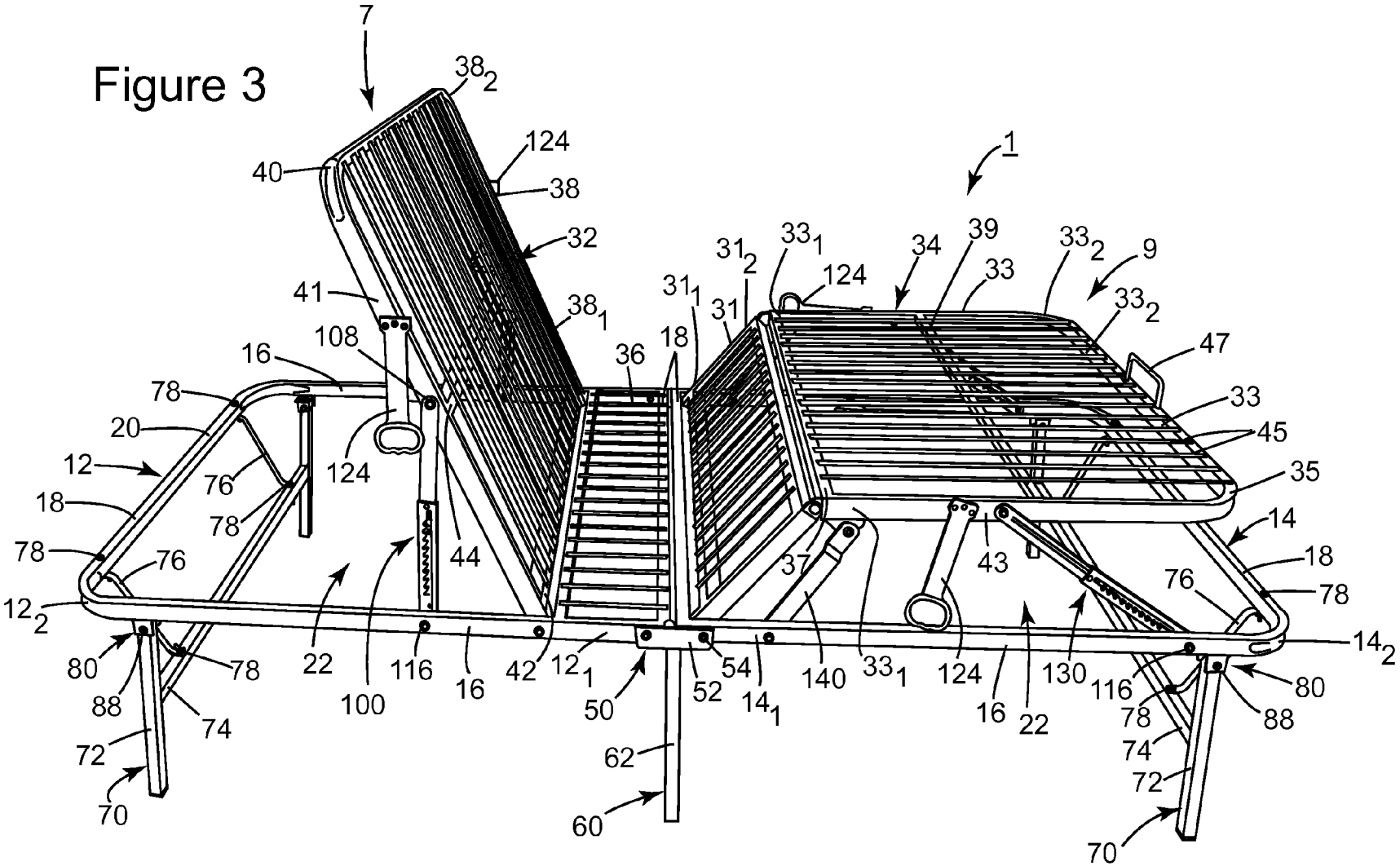
FIG. 3 is a perspective view of the adjustable foldable bed frame of FIG. 1 in open, reclined and elevated configurations.
Figure 4:
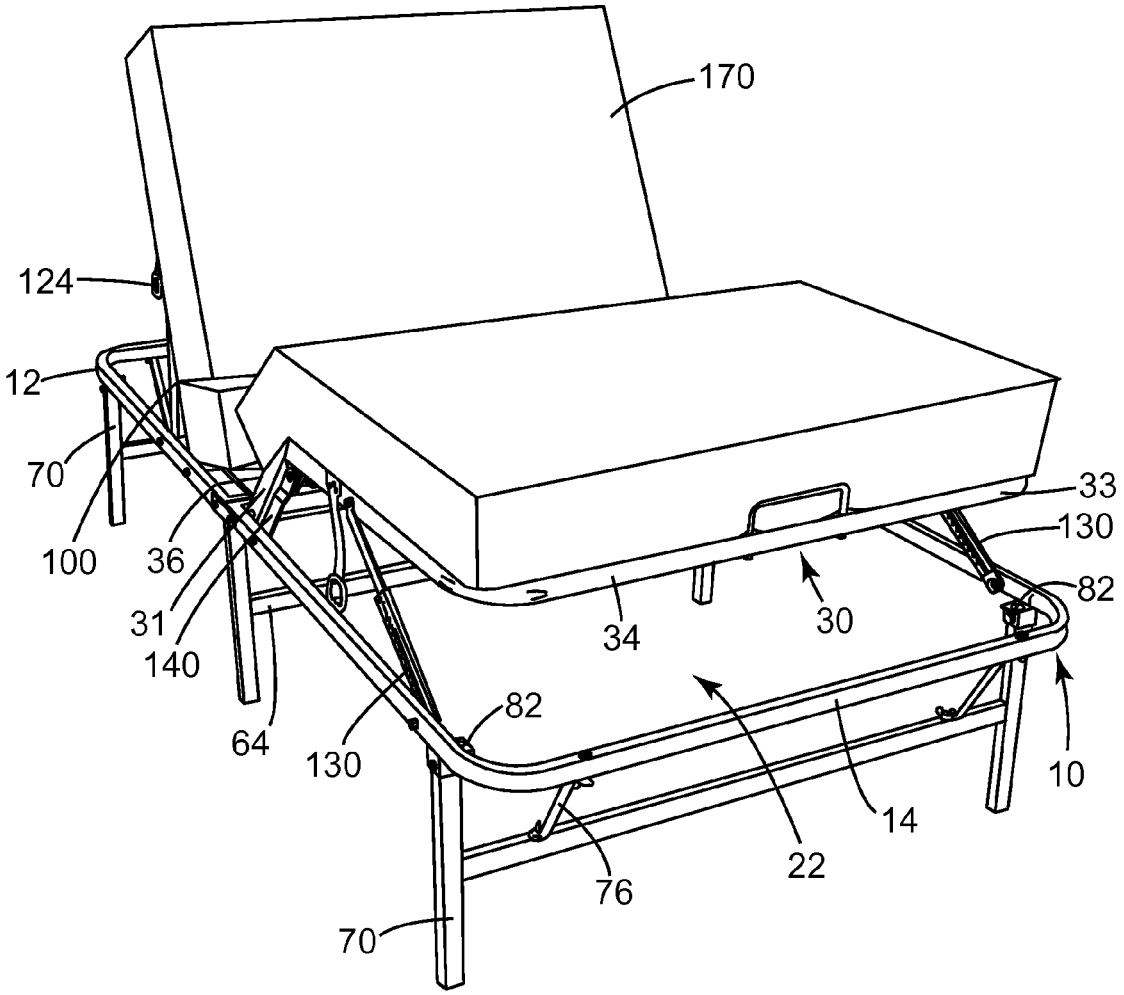
FIG. 4 is a perspective view of the adjustable foldable bed frame shown in FIG. 3 with an embodiment of a support mattress engaged thereto.

Referring to the drawings in detail, there is shown an embodiment of an adjustable foldable bed frame 1 of the present invention which is used, in general, as a mattress support (as shown in FIG. 4) and is adapted to fold from an open configuration (as shown in FIGS. 2-3) to a closed configuration (as shown in FIG. 1). The bed frame 1 is also adjustable from a flat configuration (as shown in FIG. 2) to reclined and elevated configurations (as shown in FIG. 3).

Referring to FIGS. 2 and 3, the foldable bed frame includes an outer assembly 10 and an inner assembly 30. The outer assembly 10 includes a body section 12 and a leg section 14 with each section 12, 14 having a proximal end $\mathbf{12}_1$, $\mathbf{14}_1$ and a distal end $\mathbf{12}_2$, $\mathbf{14}_2$. In the preferred embodiment, each of the sections 12, 14 are substantially identical to each other but one with ordinary skill in the art will recognize that each section 12, 14 could vary in size and shape without departing from the spirit and scope of the present invention. Each section 12, 14 includes a pair of opposing longitudinal beams 16 fixedly coupled to a pair of opposing lateral beams 18 to form a substantially rectangular periphery 20 with an opening 22. In the preferred embodiment, the beams 16, 18 are constructed of a hollow tubular metal beam or bar having a substantially rectangular cross-section to reduce the overall weight of the outer assembly while maintaining strength and stability but other materials such as high-strength plastics and the like could be used. It is preferred that the distal ends of the sections $\mathbf{12}_2$, $\mathbf{14}_2$ are formed by bending a continuous bars at opposing right angles but the three bars could be separately connected by other methods such as welding or by fasteners to form the distal ends as well. The lateral beam 18 at the proximal ends $\mathbf{12}_1$, $\mathbf{14}_1$ are welded onto opposing longitudinal beams 16 but fasteners could be used to attach the beams as well.

Referring again to FIGS. 2 and 3, the proximal ends of each section $\mathbf{12}_1$, $\mathbf{14}_1$ are pivotally coupled together by a pair of first coupling members 50 for movement between an open configuration whereby the sections 12, 14 are co-planar (as shown in FIGS. 2 and 3), and a closed configuration whereby the sections 12, 14 are parallel with each other (as shown in FIG. 1). In the preferred embodiment, each first coupling member 50 includes a pair of opposing plates 52 with the longitudinal beams 16 disposed therebetween. A pair of fasteners 54, such as screws, rivets or the like, extend through the opposing plates 52 and the longitudinal beams 16 to provide a collective secure pivotal connection for each section 12, 14. A central leg assembly 60 is fixedly coupled to the pair of first coupling members 50. The central leg assembly 60 includes a pair of spaced apart vertical supports 62 which are fixedly coupled together with a horizontal support 64 (shown in FIG. 4), preferably by welding. Referring to FIG. 1, each vertical support 62 is fixedly coupled to a lower inner portion of a corresponding first coupling member 50 by conventional welding methods. Each vertical support 62 includes a top surface 66 which engages the longitudinal beams 16 when the bed frame 1 is in the open configuration to provide support for the mid-portion of the bed frame 1. One of ordinary skill in the art will recognize that the first coupling members could take on other forms such as, for example, a U-shaped member such that the vertical supports could be fixedly coupled to a bottom surface of the U-shaped member while the longitudinal beams are supported on an opposing top surface of the U-shaped member.

Referring to FIGS. 2 and 3, the foldable bed frame also includes a pair of outer leg assemblies 70 which are each pivotally coupled to distal ends of each section $\mathbf{12}_2$, $\mathbf{14}_2$. Similar to the central leg assembly 60, each outer leg assembly 70 includes a pair of spaced apart vertical supports 72 which are fixedly coupled together with a horizontal support 74, preferably by welding. The distal ends of each section $\mathbf{12}_2$, $\mathbf{14}_2$ include a pair of substantially U-shaped third coupling members 80. Each third coupling member 80 includes a base member 82 (shown in FIG. 4) extending inwardly toward the opening of each section 22 and a pair of spaced apart wall members 84 extending downwardly from the base member 82. A top surface (not shown) of the base member 82 is fixedly attached to a bottom portion (not shown) of the longitudinal beams 16, preferably by welding. A top portion of each outer leg assembly vertical support 72 is positioned between and pivotally coupled to the wall members 84 by a fastener 88, such as a screw or rivet, to provide a collective secure pivotal connection. Each outer leg assembly 70 is further supported by a pair of leg support braces 76. Each leg support brace 76 is detachably coupled to a horizontal support 74 on one end and a lateral beam 18 at a distal end $\mathbf{12}_2$, $\mathbf{14}_2$ on another end each by a fastener 78 such as a nut and bolt combination or the like. Each outer leg assembly 70 is movable between the open configuration whereby each outer leg assembly 70 extends downwardly from each corresponding section 12, 14 and the leg support braces 76 are fixed to the horizontal support 74 and lateral beam 18 (as shown in FIGS. 2 and 3), and the closed configuration whereby the leg support braces 76 are detached from either the horizontal support 74 or the lateral beam 18 and each outer leg assembly 70 lies parallel with each corresponding section 12, 14 (as shown in FIG. 1).

Referring again to FIGS. 2 and 3, the foldable bed frame further comprises an inner assembly 30 having a body component 32 and a leg component 34 positioned within the opening 22 of the body section 12 and the leg section 14, respectively. The body component 32 includes a central portion 36 for supporting a mid-section of a user's body, and is positioned at the body section proximal end $\mathbf{12}_1$ and is formed integral to the body section 12. The body component 32 also includes a torso portion 38 for supporting an upper-section of a user's body, and is positioned between the central portion 36 and the body section distal end $\mathbf{12}_2$. The torso portion 38 is formed similarly to the body section 12 in that a continuous hollow tubular metal bar 40 having a substantially rectangular cross-section is bent at two right angles and then welded together with a lateral bar 42 at an opposing end. The torso portion 38 is further reinforced by welding an additional lateral bar 44 intermediate the opposing longitudinal ends $\mathbf{38}_1$, $\mathbf{38}_2$ of the torso portion 38. The torso portion 38 also includes a plastic handle 124 fixedly pivotally connected to each outer side surface 41.

Referring again to FIGS. 2 and 3, the leg component 34 inner assembly 30 includes a thigh portion 31 and a calf portion 33. The thigh portion 31 supports an upper region of a user's legs, and includes a proximal end $\mathbf{31}_1$ and a distal end $\mathbf{31}_2$, and is substantially rectangular and formed of four separate hollow metallic bars fixedly coupled together by welding. In the preferred embodiment, the proximal end of the thigh portion $\mathbf{31}_1$ is collectively pivotally coupled to the leg section proximal end $\mathbf{14}_1$ and the first coupling member 50 to minimize additional components needed to construct the bed frame 1. However, one of ordinary skill in the art will recognize that the thigh portion 31 could be pivotally coupled to other portions of the leg section proximal end $\mathbf{14}_1$. The calf portion 33 of the leg component 34 supports a lower leg region of a user's body, and has a proximal end $\mathbf{33}_1$ and a distal end $\mathbf{33}_2$. The calf portion 33 is also formed similarly to the body section 12 in that a continuous hollow metal bar 35 having a substantially rectangular cross-section is bent at two right angles and then welded together with a lateral bar 37 at an opposing end. The calf portion 33 is further reinforced by welding an additional lateral bar 39 intermediate the opposing longitudinal ends of the calf portion $\mathbf{33}_1$, $\mathbf{33}_2$. The proximal end of the calf portion $\mathbf{33}_1$ is pivotally coupled to the distal end of the thigh portion $\mathbf{31}_2$. A pivoting axis formed between the thigh and calf portions 31, 33 allows a user to comfortably bend her knees while resting on the bed frame 1. A foot bar 47 is fixedly coupled, preferably by welding, to a top surface of the calf portion distal end $\mathbf{33}_2$ to prevent a mattress from shifting beyond the end of the bed frame 1. The calf portion 33 also includes a plastic handle 124 fixedly pivotally connected to each outer side surface of the calf portion 43.

Each portion of the inner assembly 30 includes a plurality of equally spaced apart support wires 45 constructed of solid but thin metal bars which are welded onto top surfaces of each portion 31, 33, 36, 38 to maintain the light-weight character of each portion 31, 33, 36, 38. The support wires 45 are substantially co-planar when the body and leg components 32, 34 are in a first and second flat configuration 3, 5, respectively, as shown in FIG. 2, to provide an even support surface for a mattress. In the preferred embodiment, the support wires 45 are arranged longitudinally but they could also be arranged laterally or diagonally so long as the support wires 45 are substantially co-planar in the first and second flat configurations 3, 5.

Figure 5:
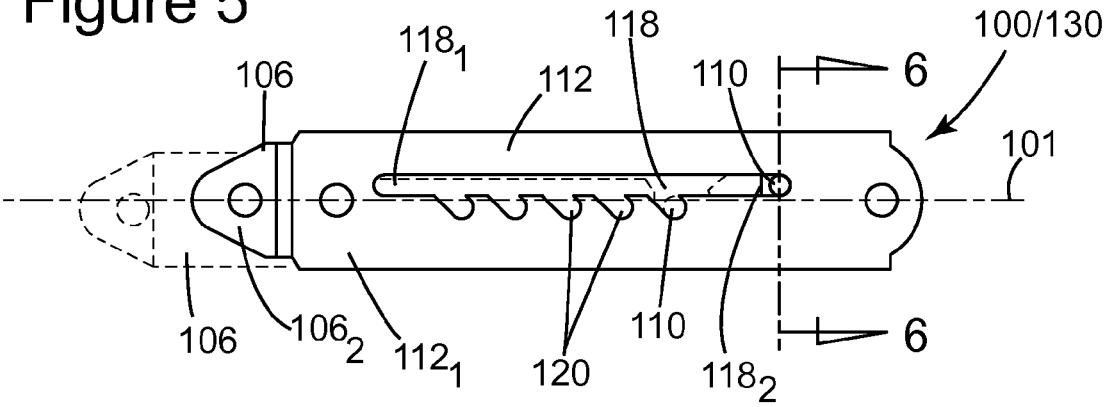
FIG. 5 is a side view of an embodiment of an adjustable support member of the present invention.
Figure 6:
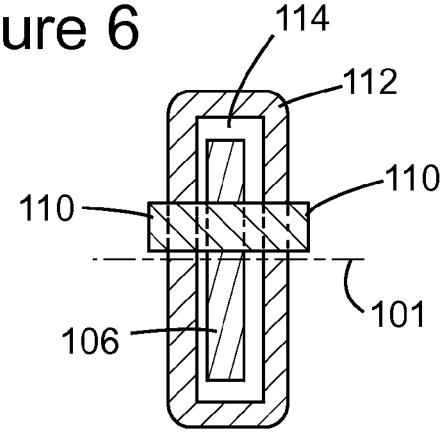
FIG. 6 is a sectional view of a cross-section denoted 6-6 of the adjustable support member of FIG. 5.
Figure 7:
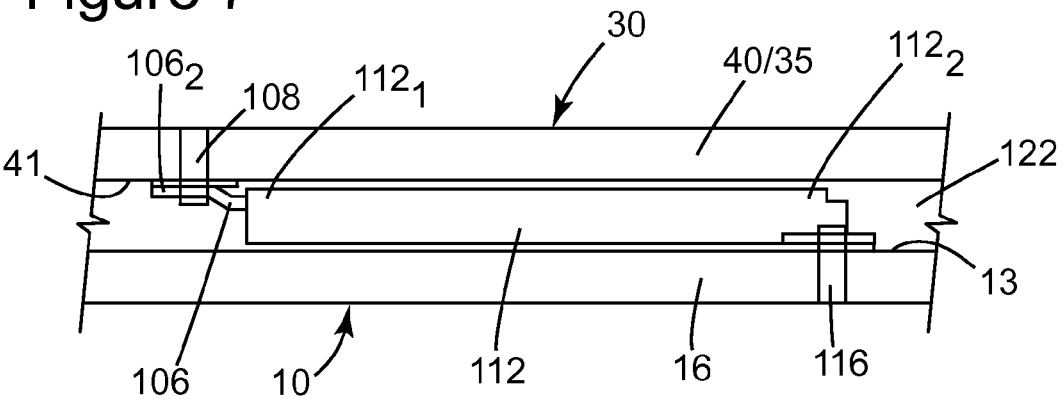
FIG. 7 is a top plan view of the adjustable support member of FIG. 5.

Referring to FIG. 3, the torso portion of the inner assembly 38 is coupled to the body section of the outer assembly 12 by a first adjustable support member 100. Referring specifically to FIGS. 5-7, which shows an alternative embodiment, the first adjustable support member 100 includes an inner sliding member 106 slidably connected within an outer sliding member 112. The inner sliding member 106 is formed of a high-strength metallic elongated plate having a proximal end (not shown) positioned within the outer sliding member 112 and a distal end $\mathbf{106}_2$ pivotally connected to an outer side surface of the torso portion 41 by a fastener 108. The proximal end of the inner sliding member includes a locking pin 110 formed integrally on the inner sliding member 106 and extends outwardly normal from each opposing side surface of the inner sliding member 106 as shown in FIG. 6. The outer sliding member 112 is formed of a high-strength metallic elongated casing having a proximal end $\mathbf{112}_1$ with a slot 114 for receiving the inner sliding member 106 and a distal end $\mathbf{112}_2$ pivotally connected to an inner side surface of the body section 13 by a fastener 116. Each opposing side wall of the elongated casing 112 further includes a matching channel 118 and a plurality of notches 120 extending from the channel 118 for guiding the locking pin 110 to and from each notch 120. The position of the inner sliding member 106 when the locking pin 110 is engaged with the channel 118 is such that the inner and outer sliding members 106, 112 are substantially centered along a longitudinally extending center line 101. The positions of the inner sliding member 106 and the locking pin 110 when the locking pin 110 is engaged with a notch 120, shown in dashed lines in FIG. 5, is such that the inner sliding member 106 is slightly below center 101. In the preferred embodiment, the outer sliding member 112 includes ten notches as shown in FIGS. 3 and 4, but less notches could be included as shown in the alternative embodiment in FIGS. 5-7. In the preferred embodiment, the first adjustable support member 100 has a thickness that is slightly less than a space 122 formed between the inner and outer assemblies 30, 10 (as shown in FIG. 7) and a width that is substantially similar to the width of the longitudinal beams of the body section 16.

Referring to FIG. 3, the inner assembly calf portion 33 is coupled to the leg section of the outer assembly 14 by a second adjustable support member 130. In the preferred embodiment, the second adjustable support member 130 is identical to the first adjustable support member 100, and is pivotally connected to the calf portion bar 35 on one end and the leg section longitudinal beam 16 on another end, as described in detail above. Similarly, the second adjustable support member 130 preferably has ten different adjusting levels, however, more or less notches could be used as shown, for example, in FIGS. 5-7. Moreover, one of ordinary skill in the art will recognize that other adjustable devices could be used in place of the first and second adjustable support members without departing from the spirit and scope of the present invention.

Referring again to FIG. 3, the calf portion 33 is further supported by a second coupling member 140 pivotally coupling the calf portion proximal end $\mathbf{33}_1$ and the leg section proximal end $\mathbf{14}_1$. The second coupling member 140 is constructed of a high-strength metal and is substantially Z-shaped to provide an offset to accommodate for the space provided between the inner and outer assemblies 122 (shown in FIG. 7). The second coupling member 140 provides additional support for the leg component 34 and ensures that the calf portion 33 remains horizontal. Furthermore, the second coupling member 140 restricts the thigh portion 31 from pivoting downward beyond the second flat configuration 5.

In operation, referring to FIG. 2, when the bed frame 1 is used as flat sleep surface the outer assembly 10 is extended to the open configuration and the torso and calf portions of the inner assembly 38, 33 are extended to first and second flat configurations 3, 5, respectively. In this setup, the locking pins 110 of the first and second adjustable support members 100, 130 are engaged with the channel 118 at the distal end $\mathbf{118}_2$ as shown in FIG. 5.

Referring to FIG. 3, to adjust the torso portion 38 to a reclined configuration 7, the distal end of the torso portion $\mathbf{38}_2$ is lifted upward either by engaging the torso portion 38 directly or by lifting one or both handles 124 upward. During this process, referring to FIG. 5, with respect to each opposing first adjustable support member 100, the inner sliding member 106 is extended from the outer sliding member 112 and the locking pins 110 travel through the channel 118 toward the proximal end of the outer sliding member $\mathbf{112}_1$ as the locking pin 110 engages each notch 120. When the torso portion 38 is positioned at a desired angle with respect to the body section 12, the locking pin 110 remains engaged with the corresponding notch 120. When the user desires to reset the torso portion 38 to a different reclined configuration or return to the first flat configuration 3, the torso portion 38 is engaged by the user until the locking pin 110 is positioned at an extreme proximal end of the channel $\mathbf{118}_1$ and the torso portion 38 is lowered as the locking pin 110 travels though the channel 118 toward the distal end of the outer sliding member $\mathbf{112}_2$ until the locking pin 110 is positioned at an extreme distal end of the channel $\mathbf{118}_2$. The first adjustable support member 100 forms a rigid connection between the torso portion 38 and the body section 12 such that movement of the locking pins 110 on each opposing first adjustable support member 100 is synchronized. Thus, the user is capable of adjusting the torso portion 38 to a predetermined reclined configuration 7 or the first flat configuration 3 by engaging only one handle 124 or only one side of the torso portion 38.

Referring to FIGS. 2 and 3, to adjust the thigh and calf portions 31, 33 to an elevated configuration 9, the distal end of the calf portion $\mathbf{33}_2$ is lifted upward either by engaging the calf portion 33 directly or by lifting one or both handles 124 upward. During this process, referring to FIG. 5, with respect to each opposing second adjustable support member 130, the inner sliding member 106 is extended from the outer sliding member 112 and the locking pin 110 travels through the channel 118 toward the proximal end of the outer sliding member $\mathbf{112}_1$ as the locking pin 110 engages each notch 120. When the calf portion 33 is positioned at a desired height with respect to the leg section 14, the locking pin 110 remains engaged with the corresponding notch 120. When the user desires to reset the calf portion 33 to a different elevated configuration or return to the second flat configuration 5, the calf portion 33 is engaged by the user until the locking pin 110 is positioned at an extreme proximal end of the channel $\mathbf{118}_1$ and the calf portion 33 is lowered as the locking pin 110 travels though the channel 118 toward the distal end of the outer sliding member $\mathbf{112}_2$ until the locking pin 110 is positioned at an extreme distal end of the channel $\mathbf{118}_2$. The second adjustable support member 130 forms a rigid connection between the calf portion 33 and the leg section 14 such that movement of the locking pins 110 on each opposing second adjustable support member 130 is synchronized. Thus, the user is capable of adjusting the calf portion 33 to a predetermined elevated configuration 9 or the second flat configuration 5 by engaging only one handle 124 or only one side of the calf portion 33.

The articulation of the torso and calf portions of the inner assembly 38, 33 provides a comfortable and efficient positioning of the user for different activities such as eating, sleeping, watching television and relaxing. Furthermore, the capability of the torso and calf portions 38, 33 to independently adjust or articulate to desired configurations provides the user with additional benefits. For example, the bed frame could be adjusted so that the torso portion is in the first flat configuration 3 while the calf portion is in an elevated configuration 9. This type of configuration could benefit those with back problems or individuals with leg injuries.

Referring to FIGS. 1 and 2, the bed frame 1 is folded by retracting the inner assembly torso and calf portions 38, 33 to their first and second flat configurations 3, 5, respectively, as shown in FIG. 2. The leg support braces 76 are disengaged from the outer assembly body and leg sections 12, 14 and the outer leg assemblies 70 are folded inward. The outer assembly body and leg sections 12, 14 are pivoted downward toward each other into the closed configuration as shown in FIG. 1 to form a compact folded bed frame for easy storage and transport. In the closed configuration, the inner and outer assemblies 30, 10 could be further secured to each other by a tie or the like to ensure that the inner assembly 30 does not shift from the first and second flat configurations 3, 5 during storage or transport.

Figure 8:
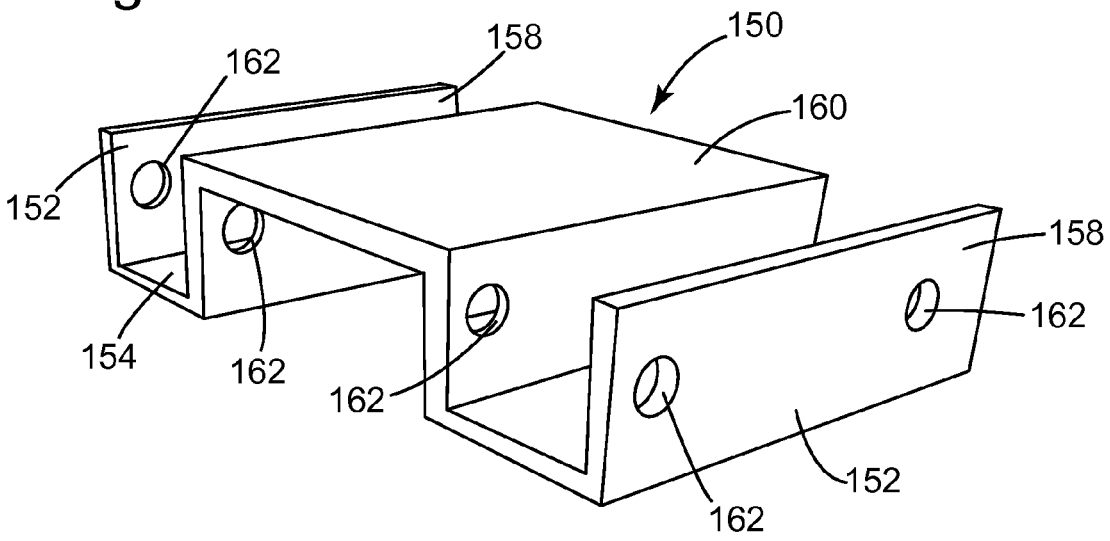
FIG. 8 is a perspective view of an embodiment of a connecting bracket assembly of the present invention.

In the preferred embodiment, the bed frame 1 is manufactured in three different sizes—75"×39" (Twin); 80"×38" (Twin XL); and 80"×30". The bed frames 1 could be used individually or combined to form a support surface for larger mattresses. For example, two 80"×30" bed frames could be combined and positioned adjacent to each other to form a 80"×60" (Queen) bed frame, and two 80"×38" (Twin XL) bed frames could be combined and positioned adjacent to each other to form a 80"×76" (King) bed frame. One of ordinary skill in the art will recognize that the bed frame 1 could be manufactured with different dimensions to conform with local standards globally. Referring to FIG. 8, a connecting bracket assembly 150 constructed of a high-strength metal or strong plastic is provided for securely attaching the adjacent bed frames 1 together and so that the inner assemblies 30 of the adjacent bed frames could be easily collectively adjusted. The connecting bracket assembly 150 includes two substantially U-shaped outer brackets 152 each having a base 154 and opposing inner and outer walls 156, 158. The inner walls of the outer brackets 156 are coupled together with a central connecting member 160 to form an integral bracket assembly 150. The width of each U-shaped outer bracket 152 is substantially similar to the width (or lateral thickness) of a longitudinal bar of the inner assembly 35. The distance between each outer bracket inner wall 156 is substantially similar to the combined distance of twice the width (or lateral thickness) of a longitudinal beam of the outer assembly 16 and approximately twice the distance between inner and outer assemblies 122. The height of the walls 156, 158 is substantially similar to the vertical thickness of the longitudinal bar of the inner assembly 35 and the longitudinal beam of the outer assembly 16. The walls of the U-shaped outer bracket 156, 158 each include a pair of apertures 162 which are substantially aligned from one wall to another wall forming two common axes. Each inner assembly longitudinal bar 35 of the torso and calf portions 38, 33 includes a pair of apertures (not shown) which correspond to the pair of wall apertures 162.

In operation, adjacent longitudinal beams 16 of adjacent bed frames 1 are positioned below the central connecting member 160 and corresponding longitudinal bars of the torso portion 38 and the calf portion 33 are each positioned within the U-shaped outer brackets 152. In the preferred embodiment, for each outer bracket 152, a bolt (not shown) is inserted through each aligned apertures 162 and locked with a nut (not shown) with a head portion of the bolt positioned under the central connecting member 160 and within the space between the inner and outer assemblies 122, and the nut portion positioned at an open inner part 22 of the inner assembly 30. Thus, in this embodiment, four separate nut-and-bolt combinations are utilized and movement of the torso and calf portions 38, 33 is not interfered with by the outer assembly 10. The torso and calf portions 38, 33 are adjusted in the same way as described above for an individual bed frame 1, and the connecting bracket assemblies 150 are disengaged and each bed frame 1 is folded in the same manner as described above.

Referring to FIG. 4, a mattress 170 having four separate pieces corresponding to each inner assembly portion is used with the bed frame 1. The mattress 170 is provided with an enclosed cover having separate compartments for each piece such that the separate pieces could be articulated with corresponding inner assembly portions 36, 38, 31, 33. It is preferred that memory foam is used but other mattresses or supports including separate spring mattresses could be inserted into the cover as well.

No special materials are required for construction of the bed frame 1. The inner and outer assemblies 10, 30 are preferably metal such as steel or aluminum, but other materials with equivalent strength and rigidity including high-strength polymers or the like could be used. Moreover, although the present invention is disclosed as being embodied in a bed frame, such invention could readily be adapted to lounges, chairs, beach chairs, or the like.

The present disclosure includes that contained in the appended claims as well as that of the foregoing description. Although this invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention.

The invention claimed is:

1. An adjustable foldable bed frame comprising:

an outer assembly formed of a body section and a leg section, each section forming a substantially rectangular periphery, first coupling members pivotally coupling the sections for movement between an open configuration wherein the sections lie in a common horizontal plane and a closed configuration wherein the sections lie parallel with each other;

a central leg assembly coupled to the first coupling members and extending therefrom;

a pair of outer leg assemblies, each pivotally coupled to outer ends of the leg and body sections, respectively, each of the foldable legs movable between the open configuration wherein the legs extend downwardly from the leg and body sections, and the closed configuration wherein the legs lie parallel with the leg and body sections;

an inner assembly formed of a body component and a leg component, the body component and the leg component positioned inside the periphery of the body section and the leg section, respectively, the body component comprising a central portion fixedly coupled to the body section and a torso portion pivotally coupled to the body section adjacent the central portion, the leg component comprising a thigh portion pivotally coupled to the leg section and a calf portion pivotally coupled to the thigh portion;

at least one first adjustable support member pivotally coupling the torso portion to the body section;

at least one second adjustable support member pivotally coupling the calf portion to the leg section; and a plurality of second coupling members fixedly attached to the outer assembly and pivotally coupled to the outer leg assemblies;

wherein the torso portion is adjustable from a first flat configuration wherein the torso portion is substantially co-planar with the body section to a plurality of predetermined reclined configurations, wherein the calf portion is adjustable from a second flat configuration wherein the calf portion is substantially co-planar with the leg section to a plurality of predetermined elevated configurations wherein the entire calf portion is positioned above the leg section, and wherein at least one of the second coupling members comprises a support surface extending inwardly from the outer assembly for supporting solely a distal end of the inner assembly when in at least one of the flat configurations.

2. The adjustable foldable bed frame according to claim 1, wherein the at least one first adjustable support member comprises a first set of notches, each notch of the first set corresponding to a predetermined reclined configuration.

3. The adjustable foldable bed frame according to claim 1, wherein the at least one second adjustable support member comprises a second set of notches, each notch of the second set corresponding to a predetermined elevated configuration.

4. The adjustable foldable bed frame according to claim 1, further comprising at least one third coupling member having opposing ends, each opposing end pivotally coupled to the calf portion and the leg section, respectively.

5. The adjustable foldable bed frame according to claim 4, wherein each third coupling member is substantially Z-shaped such that an offset is provided between opposing ends.

6. The adjustable foldable bed frame according to claim 4, wherein the calf portion is substantially horizontal in the elevated configurations.

7. The adjustable foldable bed according to claim 1, wherein the thigh portion is formed at an angle with respect to the leg section when the calf portion is in a predetermined elevated configuration.

8. The adjustable foldable bed frame according to claim 1, further comprising a plurality of handles fixedly coupled to the torso and calf portions.

9. The adjustable foldable bed frame according to claim 1, further comprising a mattress having a plurality of foldable support sections corresponding to each portion of the inner assembly and substantially similar in size as each portion of the inner assembly.

10. The adjustable foldable bed frame according to claim 1, further comprising at least one connecting bracket assembly for fixedly coupling inner assemblies of adjacent adjustable foldable bed frames such that adjacent torso portions are collectively adjustable from the first flat configuration to the plurality of predetermined reclined configurations, and adjacent leg portions are collectively adjustable from the second flat configuration to the plurality of predetermined elevated configurations.

* * * * *